United States Patent [19]

Straubel et al.

[11] Patent Number: 4,554,903

[45] Date of Patent: Nov. 26, 1985

[54] FUEL INJECTION APPARATUS FOR INJECTING A FUEL MIXTURE COMPRISING AT LEAST TWO COMPONENTS

[75] Inventors: Max Straubel, Stuttgart; Klaus-Dieter Zimmermann, Vaihingen, both of Fed. Rep. of Germany

[73] Assignee: Robert Bosch GmbH, Stuttgart, Fed. Rep. of Germany

[21] Appl. No.: 585,464

[22] Filed: Mar. 2, 1984

[30] Foreign Application Priority Data

Mar. 19, 1983 [DE] Fed. Rep. of Germany ..... 3310049

[51] Int. Cl.[4] ..... F02M 39/00

[52] U.S. Cl. ..... 123/575; 123/446; 123/447; 123/458

[58] Field of Search ..... 123/458, 446, 447, 495, 123/500, 501, 502, 357, 509, 506, 575–578; 417/540, 542, 494, 499; 239/88–95, 585

[56] References Cited

U.S. PATENT DOCUMENTS

| | | | |
|---|---|---|---|
| 2,793,629 | 5/1957 | Neely | 123/575 |
| 3,022,425 | 2/1962 | Rockstead | 123/577 |
| 3,749,097 | 7/1973 | Grow | 123/575 |
| 4,378,775 | 4/1983 | Straubel et al. | 123/458 |
| 4,402,296 | 9/1983 | Scharz | 123/576 |
| 4,448,167 | 5/1984 | Schmid | 123/446 |
| 4,463,734 | 8/1984 | Akeroyd | 123/576 |

FOREIGN PATENT DOCUMENTS

| | | | |
|---|---|---|---|
| 0156246 | 12/1980 | Japan | 123/578 |
| 230496 | 3/1926 | United Kingdom | 123/458 |
| 468958 | 1/1937 | United Kingdom | 123/458 |
| 2086491 | 5/1982 | United Kingdom | 123/458 |

*Primary Examiner*—Carl Stuart Miller

*Attorney, Agent, or Firm*—Edwin E. Greigg

[57] ABSTRACT

In the pump work chamber of a fuel injection pump, the main fuel delivered by a first metering valve is admixed with at least one further additional fluid by means of a second metering valve via a second inflow conduit. The two metering valves inserted into the inflow conduits and being electromechanically actuatable receive control pulses ($I_{Z1}$, $I_{Z2}$) dependent on operating characteristics (n, T, S, L) from an electric control unit. By means of the metering into the pump work chamber, the respective amounts of the fuel components are very well mixed or emulsified and pumped to the injection nozzle. The electric triggering of the metering valves enables a rapid adaptation from one stroke to another of the mixture ratio of the various fuel components to the instant operating condition of the internal combustion engine. A particularly advantageous feature is the use of a refill reservoir receiving the return-flow fuel quantity diverted at the end of supply and returning it to the pump work chamber before the next subsequent supply stroke begins, this refill chamber being connected to an overflow conduit controlled by an oblique control edge on the pump piston.

6 Claims, 1 Drawing Figure

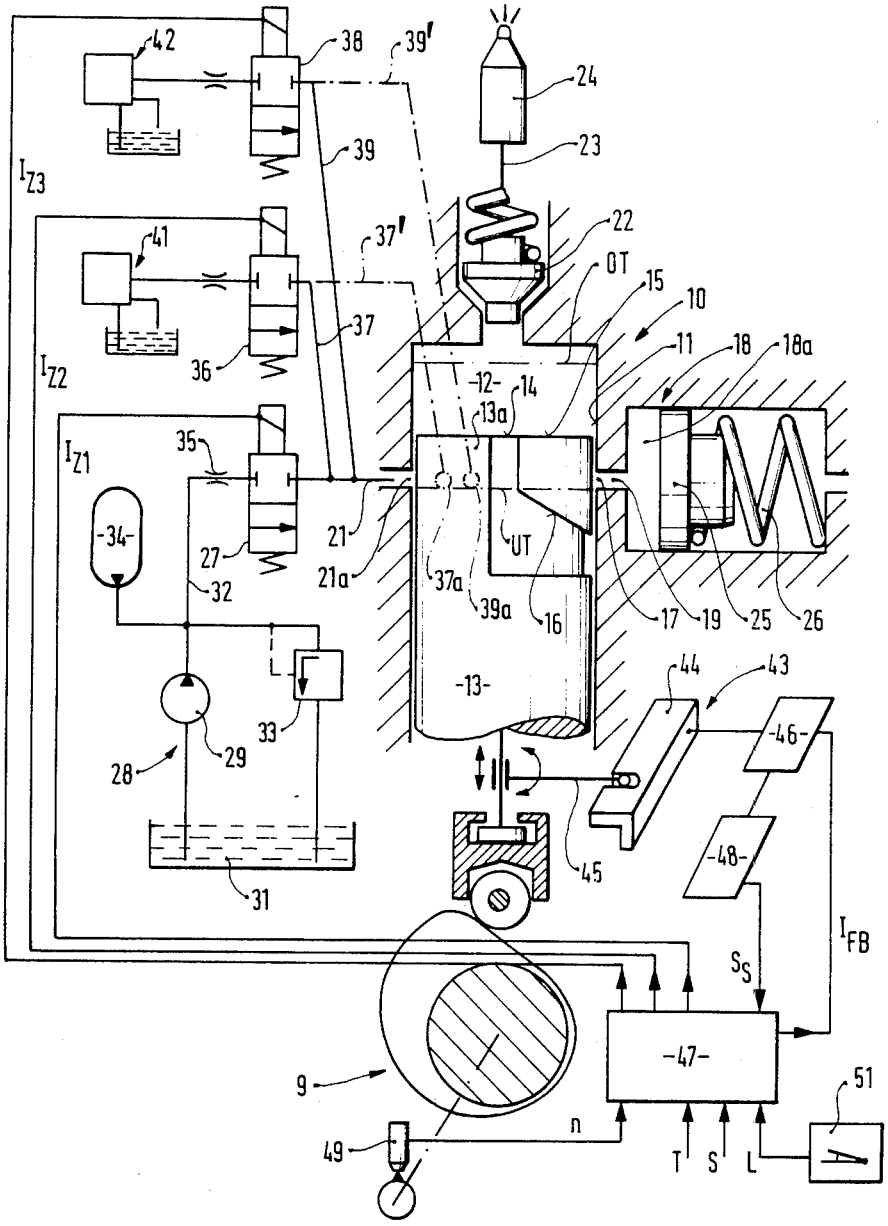
42
38
39'
24
39
23
$I_{Z3}$
41
37'
22
OT
15
10
37
11
18
18a
36
$I_{Z2}$
-12-
14
13a
$I_{Z1}$
35
-34-
21
UT
27
21a
37a
32
39a
16
17
19
25
26
L
-13-
44
43
33
-46-
29
28
45
-48-
31
$I_{FB}$
$S_S$
-47-
9
51
49
n
T
S
L

FUEL INJECTION APPARATUS FOR INJECTING A FUEL MIXTURE COMPRISING AT LEAST TWO COMPONENTS

BACKGROUND OF THE INVENTION

The invention is based on a fuel injection apparatus which serves to inject a fuel mixture comprising a main fuel and at least one additional fluid or additional fuel.

For use in Diesel engines, a fuel mixture for instance comprising Diesel fuel and water, or Diesel fuel and alcohol, is supplied by the associated fuel injection pump. In known types of apparatus, mixing nozzles of appropriate embodiment are used in order to assure intimate mixing or emulsification of the two components of the fluid, or else the fuel is already delivered in the form of a mixture, via a mixing device, to the suction chamber of the fuel injection pump. Since under changing operating conditions the fuel mixture must be changed and adapted very rapidly, and it is also necessary to avoid separation of the fuel components as much as possible, injection apparatus is already known in which the fuel mixing is performed directly in the pump work chamber of the fuel injection pump during the intake stroke thereof. For instance, a fuel injection apparatus that is equipped with the characteristics set forth herein is known from Austrian Pat. No. 102,637 which is the same as British Pat. No. 230,496. A manually adjustable throttle valve inserted into the second inflow conduit for the additional fluid serves as a control device to adjust the mixture ratio. With this throttle valve, the mixture ratio of the fuel mixture aspirated during the intake stroke of the pump piston can be adjusted roughly; however, very precise adjustment of the mixture ratio cannot be attained with such a device, nor can a change be made in this mixture ratio that reacts very rapidly to changing operating conditions. In the exemplary embodiment shown in FIGS. 4 and 5, having two metering valves embodied as suction valves, the inflow of the two fluid components is effected via two chambers disposed preceding the pump work chamber; these chambers disadvantageously increase the idle volume in the pump work chamber. As a result, it is impossible to generate very high injection pressures, and the fuel metering precision is reduced. These disadvantages are also present in the other exemplary embodiments, shown in FIGS. 1-3 of Austrian Pat. No. 102 637, in each of which a chamber connected laterally to the pump work chamber is provided to receive the head of the suction valve that is moved during the intake stroke.

OBJECT AND SUMMARY OF THE INVENTION

It is accordingly an object of the present invention to keep the idle volumes in the pump work chamber, which are harmful in high-pressure injection, as small as possible and to assure a rapidly reacting mixing of the fuel components in the pump work chamber. Separation of the fuel components which might take place when the fuel injection apparatus is not in operation must not be allowed to have any deleterious effects.

In the fuel injection apparatus according to the invention, the idle volumes in the pump work chamber are reduced to a minimum, and the at least two electromechanically actuated metering valves inserted into the inflow conduits, which receive their control pulses from an electrical control device, enable the mixture ratio to be adapted from one stroke to the next to existing engine conditions.

As a result, advantageous embodiments and further developments of the fuel injection apparatus disclosed herein are possible. For instance, in a fuel injection apparatus embodied herein, the idle volumes are not substantially increased by the inflow conduits, while in a fuel injection apparatus embodied herein, the inflow conduits that are separated from one another spatially and discharge directly into the pump work chamber can be disposed such that the required connecting lines are short in length. If the inflow opening or openings are covered during the supply stroke by a control face located on the jacket face of the pump piston, as is known from U.S. Pat. No. 4,378,775, then the metering valves are also not subjected to the extremely high injection pressure prevailing during the supply stroke in the pump work chamber. This makes it possible to use fast-switching magnetic valves that can withstand only medium pressure.

To prevent the fuel mixture located in the pump work chamber from getting into the tank for the main fuel, the invention is preferably applicable to fuel injection pumps which pump until the end of the stroke and in which there is no return-flow fuel guantity. A fuel injection apparatus has already become known from U.S. Pat. No. 4,378,775, already mentioned above, in which a return-flow fuel quantity that enables rapid closing of the injection nozzle at the end of supply is re-aspirated again during the next intake stroke. This fuel injection apparatus serves solely to pump a single-component fuel. If it were to be provided, like the subject of the present application, with an additional magnetic valve for the delivery of an additional fluid, then a portion of the fuel mixture located in the pump work chamber could not be prevented during the diversion process from getting into the tank for the main fuel. This disadvantage is overcome by the combination of characteristics set forth herein, specifically in that the fuel reservoir is embodied as a refill reservoir receiving the entire return-flow fuel quantity diverted after the end of supply and returning this quantity to the pump work chamber again prior to the next subsequent supply stroke; the overflow conduit is preferably openable by both control edges of the pump piston. The subject of a prior German patent application No. P 33 07 826.2 of the present applicant can be put to use in an inventive manner in the fuel injection apparatus herein, which serves to inject a fuel mixture.

The invention will be better understood and further objects and advantages thereof will become more apparent from the ensuing detailed description of a preferred embodiment taken in conjunction with the drawing.

BRIEF DESCRIPTION OF THE DRAWING

The sole FIGURE of the drawing illustrates a fuel injection apparatus embodied in accordance with the invention.

DESCRIPTION OF THE PREFERRED EMBODIMENT

The fuel injection apparatus shown in simplified form in the drawing serves to inject a fuel mixture and has a fuel injection pump 10, represented in cross section by a pumping element, that is driven by a mechanical cam drive 9. This fuel injection pump 10 has a pump piston 13 that is guided such as to be movable both axially and rotationally in a pump cylinder 11 and is actuated in the reciprocating direction by the cam drive 9. A pump work chamber 12 is formed between the upper end of the pump piston 13 and fuel supply pressure valve 22. The pump piston 13 has two axially offset control edges on its jacket face, specifically a first control edge 15 that is embodied by its end face 14 oriented toward the pump work chamber 12 and a second control edge 16 that is inclined relative to the longitudinal axis of the pump piston 13 and determines the end of supply. By means of the second control edge 16, an overflow opening 17 of an overflow conduit 19 leading to a fuel reservoir 18 can be opened. This fuel reservoir 18, embodied as a refill reservoir, receives the entire return-flow fuel quantity diverted after the end of supply and then returns it to the pump work chamber 12 prior to the next subsequent supply stroke. This is possible, while maintaining the smallest possible idle volumes, because the overflow conduit 19 represents the sole and direct connection between the refill reservoir 18 and the pump work chamber 12. To this end, the overflow opening 17 located at the mouth of the overflow conduit 19 into the pump work chamber 12 is opened by both control edges 15 and 16 of the pump piston 13, as will be described in greater detail below. In the bottom dead center position UT of the pump piston 13 indicated by dot-dash lines through the piston in the drawing, a first inflow conduit 21, which is preferably located diametrically opposite the overflow opening 17 and is covered by the jacket face of the pump piston during pump supply, discharges into the pump work chamber 12, which is closable in the supply direction by a pressure valve 22 and can be connected via a pressure line 23 with an injection nozzle 24.

Although a pressure reservoir or accumulator is also conceivable for receiving the return-flow fuel quantity, for instance a bladder-type reservoir utilizing gas pressure, the refill reservoir 18 is embodied here, for the sake of attaining high accuracy, as a piston reservoir, which has a reservoir chamber 18*a* and a reservoir piston 25 serving as a movable wall, which is displaceable counter to the force of a restoring spring 26 in accordance with the diverted return-flow fuel quantity.

A first metering valve 27 carrying the main fuel is inserted into the first inflow conduit 21; it is electromagnetically actuatable and its opening duration and the pressure of the fuel it carries determine the quantity of the main fuel pre-stored in the pump work chamber 12. The first metering valve 27 supplies the pump work chamber 12 via the inflow conduit 21 with the main fuel pumped from a low-pressure source 28. The low-pressure source 28 contains a feed pump 29, which aspirates the main fuel from a main fuel tank 31 via an inflow line 32 to the chamber 12 via line 21 whenever the metering valve 27 is switched over from its closed position, as shown, to its open position. A pressure limitating valve 33 determines the pressure of the fuel pumped by the feed pump 29 and returns the excess to the tank 31. A reservoir 34 assures that sufficiently large fuel quantities will be made available during the metering phase. During the fuel metering process, negative pressure prevails in the pump work chamber 12, the level of which is determined by the vapor pressure of the fuel.

In order that a precisely defined pressure drop will prevail during the fuel metering, a throttle 35 which determines the inflow cross section is inserted into the fuel inflow line to the metering valve 27; naturally it may instead be disposed inside the metering valve 27 or in the inflow conduit 21.

The fuel injection apparatus is provided with a second metering valve 36, which supplies the pump work work chamber 12 with an additional fluid, such as water or alcohol, which second metering valve 36 is inserted into a second inflow conduit 37 and serves to meter the additional fluid that is to be admixed with the main fuel. This second inflow conduit 37 provided with the second metering valve 36 discharges downstream of the first metering valve 27 into the first inflow conduit 21 upstream of the mouth, formed by an inflow opening 21*a*, into the pump work chamber 12. A third inflow conduit 39, provided with a third metering valve 38, discharges in the same manner into the inflow conduit 21 upstream of the inflow opening 21*a*. The additional fluid fed via the second inflow conduit 37 or the third inflow conduit 39 is drawn from a separate tank or separate fluid sources 41 and 42. In practice, the metering valves 27, 36 and 38 disposed one above the other are naturally disposed closer to the pump work chamber 12, in order to avoid having relatively large idle volumes, and then the inflow conduits 21, 37 and 39 are correspondingly shorter in length.

In order to enable the disposition of the valves such that they are distributed about the pump cylinder 11, it may also be advantageous for the second inflow conduit 37' provided with the second metering valve 36 and perhaps the third inflow conduit 39' as well to be connected to the pump work chamber 12 by means of a second and as needed a third inflow opening 37*a* and 39*a* discharging into the pump work chamber 12 at a location that is spatially separated from the inflow opening 21*a* of the first inflow conduit 21. Such a disposition is indicated in the drawing by dot-dash lines.

To prevent the metering valves 27, 36 and 38 from being subjected to the extremely high fuel pressure prevailing in the pump work chamber during fuel injection, the inflow opening 21*a*, or the inflow openings 21*a*, 37*a* and 39*a* as applicable, are covered during the supply stroke of the pump piston 13 by a control face 13*a* located on the jacket face of the pump piston 13 and are opened up only in one of the dead center positions, in the present instance bottom dead center UT, of the pump piston 13.

To correct or adjust the end of the effective supply stroke of the pump piston 13, the fuel injection pump 10 is equipped with an adjusting device 43, which in a known manner comprises a longitudinally displaceable regulating rod 44 and a steering rod 45 actuated thereby. The steering rod 45, which in a known manner comprises a steering sheath having a steering arm, takes the pump piston 13 along with it in its rotational direction, as a result of its pivoting movement, during longitudinal movements of the regulating rod 44, yet it still permits unhindered reciprocation on the part of the pump piston 13. Because of the rotation of the pump piston 13 effected by the adjusting device 43, the relative position between the overflow opening 17 and the oblique control edge 16 on the pump piston 13 varies, and as a result it is possible to define a fixed value for the return-flow fuel quantity that is diverted at the end of supply and then re-aspirated from the refill reservoir 18. This return-flow fuel quantity, together with the fuel mixture metered in the pump work chamber 12, determines the onset of supply on the part of the fuel injection pump 10.

An adjusting member 46 that actuates the regulating rod 44 electromechanically is embodied by an electromagnet, electric control motor or electrohydraulic control element, depending on the adjusting force required, and it receives its control pulse $I_{FB}$, which is dependent upon at least one operating characteristic, such as the load L or the rpm n, from an electric control unit 47. The variation in the rotational position of the oblique control edge 16, and thus the end of supply, attainable with the adjusting device 43, does not, however, in this case determine the fuel injection quantity, but rather, in combination with the function of the refill reservoir 18 already described, the change in the instant of supply onset can be changed. The position of the adjusting member 46 at a given time is measured by an adjusting path transducer 48 and fed into the control unit 47 as an adjusting path signal $S_S$.

The electromagnetically actuated metering valves 27, 36 and 39, embodied in a known manner as 2/2-way valves, receive respective metering pulses $I_{Z1}$ or $I_{Z2}$ or $I_{Z3}$, which determine their opening duration, from a control unit 47 containing an electronic regulating circuit. Additional signals dependent on further operating characteristics of the engine, such as a temperature signal T picked up at some suitable location and further signals S, are also fed into the control unit 47 in addition to an rpm signal n emitted by an rpm transducer 49. A load signal L to be fed in by a human operator is generated by a means of set-point feed 51.

The sum of the quantities of fluid components metered into the pump work chamber 12 by the opening duration of the metering valves 27, 36 and 38 in accordance with the metering pulses $I_{Z1}$, $I_{Z2}$ and $I_{Z3}$ yields the total injection quantity of the fuel mixture ejected through the injection nozzle 24.

A high degree of mixing or emulsification of the various fuel components is already effected in the inflow conduit 21 in the illustrated exemplary embodiment. In the case of supply indicated alternatively via separate inflow openings 21*a*, 37*a* and 39*a*, the mixing of the fuel components can be improved by means of an appropriately adapted (for instance, oblique) disposition of these inflow openings.

A particularly favorable disposition of the fuel injection apparatus is attained if the injection nozzle is connected by a very short pressure line 23 to the pump work chamber 12. This is particularly advantageous in the case of pump/nozzles which are combined with the injection nozzle. In principle, however, the invention can be applied to distributor injection pumps as well, in which the sole pump work chamber is supplied with the fuel mixture by means of a single set of magnetic valves, and the mixture is then pumped to the associated injection nozzles via a corresponding distributor.

Although the above description already provides some important information on the function of the fuel injection apparatus according to the invention, the mode of operation of the subject of the application will now be described below, referring to the drawing.

If the pump piston 13 is in the bottom dead center position shown at UT in dot-dash lines, then the partially evacuated pump work chamber 12 contains the entire return-flow fuel quantity positively displaced from the reservoir chamber 18*a*, to which return-flow quantity, the quantity of the main fuel to be injected and of the additional fluids to be admixed therewith is additionally added, by pre-storage in accordance with the metering pulses $I_{Z1, 2, 3}$ emitted by the control unit 47.

When the pump piston 13 begins its supply stroke and it has closed not only the inflow opening 21*a*, or the inflow openings 21*a*, 37*a* and 39*a*, but also the overflow opening 17, then as the upward movement of the pump piston 13 continues the supply onset is initiated after the compression of the hollow space remaining in the pump work chamber 12. In the drawing, the pump piston 13 is shown in a position which it assumes during fuel supply under pressure of the piston. The pressure valve 22 is opened and the fuel mixture flows via the pressure line 23 to the injection nozzle 24, from which it is injected into the associated working cylinder of the internal combustion engine. The end of supply is controlled in that the oblique control edge 16 opens the overflow conduit 19 by the oblique control edge 16 and the pressure valve 22 closes the passage to the injection nozzle 24 by the pressure valve 22. Until top dead center, which is indicated at OT in dot-dash lines, the pump piston 13 positively displaces the entire return-flow fuel quantity, with the pressure valve 22 now closed, into the reservoir chamber 18*a* of the refill reservoir 18. Upon the return or intake stroke of the pump piston 13, until the closure of the overflow conduit 19 by the oblique control edge 16, a partial quantity of the return-flow fuel quantity is recirculated to or re-aspirated into the pump work chamber. Because of the variously high pressures and the differing compression volume at the end of supply and during the intake stroke, a remnant quantity remains in the reservoir chamber 18*a*. After the opening of the overflow conduit 19 by the upper, first control edge 16 during the remainder of the stroke of the pump piston 13 until it reaches bottom dead center 12, this remnant quantity is returned to the pump work chamber 12, so that the entire return-flow fuel quantity is now present once again in the pump work chamber 12. During the next subsequent supply stroke, the operating cycle described above begins anew, to effect a new injection.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection apparatus for injecting a fuel mixture comprising at least two components, wherein at least one additional fluid or additional fuel is admixed with a main fuel to a desired ratio, an electrical control unit;

at least one pump piston having a longitudinal axis, said pump piston is guided in a pump cylinder of a fuel injection pump, acts upon a pump work chamber between said piston and a fuel supply pressure valve, and said piston is linearly actuatable by a cam drive along said longitudinal axis;

a first metering valve delivering a main fuel via a first inflow conduit, the opening duration of which said first inflow valve determines the quantity of the main fuel pre-stored in the pump work chamber;

at least one second metering valve supplying the pump work chamber with an additional fluid, which said second metering valve is inserted in a second inflow conduit and enables the flow of the additional fluid admixed with the main fluid;

said pump piston is rotatable by means of an adjusting device that serves to shift the instant of supply onset and that is provided with an electromechanical adjusting member that is triggerable by the electrical control unit, said pump piston has a first control edge formed by its end face oriented toward the pump work chamber and a second control edge inclined relative to the longitudinal axis of the pump piston for determining the end of supply; by means of said second control edge, an overflow opening of an overflow conduit leading to a fuel reservoir is openable, and that the fuel reservoir is embodied as a refill reservoir receiving the entire return-flow fuel quantity diverted after the end of supply and returning the fuel to the pump work chamber prior to the next subsequent supply stroke, said reservoir including a reservoir piston, said reservoir piston including a bottom facing toward said pump work chamber when in its non-displaced position filling an end portion of said reservoir facing said pump work chamber, and wherein the overflow conduit represents the sole and direct connection between the refill reservoir and the pump work chamber and the overflow opening located at the mouth of the overflow conduit into the pump work chamber is openable by both control edges of the pump piston;

said fuel supply pressure valve being inserted into a pressure line connecting the pump work chamber with an injection nozzle;

in which the pump work chamber is exclusively embodied by a section of the pump cylinder defined on the supply side by the pressure valve and on the drive side by the pump piston, to which chamber at least one of the inflow conduits is directly connected, that the at least two metering valves inserted into separate inflow conduits are electromechanically actuatable, and said electrical control unit emits control pulses ($I_{z1}$, $I_{z2}$, $I_{z3}$) dependent on operating characteristics (n, T, S, L) to the metering valves, the opening duration of which fixes the mixture ratio of the fuel components directed to the pump work chamber prior to each injection stroke of the pump piston.

2. A fuel injection apparatus as defined by claim 1, in which the metering of the fuel components that is fixable by means of the opening duration of the metering valves takes place at a constant pressure of the respective fluids being supplied and via constant inflow cross sections.

3. A fuel injection apparatus as defined by claim 1, in which the second inflow conduit provided with the second metering valve and as applicable every further additional inflow conduit present in the apparatus discharges downstream of the first metering valve into the first inflow conduit prior to the mouth thereof formed by an inflow opening into the pump work chamber.

4. A fuel injection apparatus as defined by claim 1, in which the second inflow conduit provided with the second metering valve and as applicable every further additional inflow conduit present in the apparatus is connected to the pump work chamber by means of a second or as applicable additional inflow opening discharging into the pump work chamber in a manner spatially separated from an inflow opening of the first inflow conduit.

5. A fuel injection apparatus as defined by claim 3, in which the inflow opening or the inflow openings is or are covered during the supply stroke of the pump piston by a control face located on the jacket face of the pump piston and opened only in one of the dead center positions (UT, OT), preferably at bottom dead center (UT), of the pump piston.

6. A fuel injection apparatus as defined by claim 4, in which the inflow opening or the inflow openings is or are covered during the supply stroke of the pump piston by a control face located on the jacket face of the pump piston and opened only in one of the dead center positions (UT, OT), preferably at bottom dead center (UT), of the pump piston.

* * * * *